US006663823B2

(12) United States Patent
Kobayashi et al.

(10) Patent No.: US 6,663,823 B2
(45) Date of Patent: Dec. 16, 2003

(54) PROCESS FOR MAKING NONWOVEN FABRIC AND APPARATUS USED FOR THIS PROCESS

(75) Inventors: Toshio Kobayashi, Kagawa-ken (JP); Satoru Tange, Kagawa-ken (JP)

(73) Assignee: Uni-Charm Corporation, Kawanoe (JP)

( * ) Notice: Subject to any disclaimer, the term of this patent is extended or adjusted under 35 U.S.C. 154(b) by 251 days.

(21) Appl. No.: 09/805,976

(22) Filed: Mar. 15, 2001

(65) Prior Publication Data

US 2001/0054783 A1 Dec. 27, 2001

(30) Foreign Application Priority Data

Mar. 30, 2000 (JP) ..... 2000-095476

(51) Int. Cl.[7] ..... D01D 5/12; D04H 3/02

(52) U.S. Cl. ..... 264/555; 264/210.8; 425/66; 425/72.2

(58) Field of Search ..... 264/210.8, 555; 425/66, 72.2

(56) References Cited

U.S. PATENT DOCUMENTS

| | | | |
|---|---|---|---|
| 5,211,903 | A | 5/1993 | Reifenhauser |
| 5,460,500 | A | 10/1995 | Geus et al. |
| 5,487,655 | A | 1/1996 | Frey et al. |
| 5,766,646 | A | 6/1998 | Geus et al. |
| 5,820,888 | A | 10/1998 | Geus et al. |

FOREIGN PATENT DOCUMENTS

| | | | |
|---|---|---|---|
| EP | 0 224 435 | A2 | 6/1987 |

*Primary Examiner*—Leo B. Tentoni
(74) *Attorney, Agent, or Firm*—Lowe Hauptman Gilman & Berner LLP

(57) ABSTRACT

A process for making a nonwoven fabric in which continuous fibers are evenly distributed and neither bundles nor lumps of the fibers, includes a guide box for continuous fibers being provided between extruding nozzles adapted to discharge the continuous fibers under hot air blast and a conveyor belt. The box has an upper end opening and a lower end opening being larger than the upper end opening. The continuous fibers are subjected to a suction effect provided from below the guide box so that the continuous fibers may be secondarily stretched and thereby thinned within the guide box.

19 Claims, 3 Drawing Sheets

PROCESS FOR MAKING NONWOVEN FABRIC AND APPARATUS USED FOR THIS PROCESS

BACKGROUND OF THE INVENTION

This invention relates to a process for making a nonwoven fabric including the steps of melt-extruding thermoplastic synthetic resin fiber and then thinning the fiber by stretching this fiber under hot air blast. This invention relates also to an apparatus used for this process.

It is well known to feed continuous fibers of melt blown thermoplastic synthetic resin onto a conveyor belt and thereby to form a nonwoven fabric. According to this well known process, a melt-extruder is provided with a plurality of nozzles arranged in an array adapted to discharge continuous fibers which are stretched and thinned under hot air blast in molten or semi-molten state.

In the case of the well known process, the continuous fibers extending parallel one to another in an orderly manner immediately after discharged from the nozzles may be deflected under the effect of the hot air blast and fused one with another in molten or semi-molten state before these continuous fibers reach the conveyor belt. Consequently, a plurality of fibers may be bundled together and/or a plurality of fibers may be intertwined together to form a fibrous lump as the fibers are cooled Such fibrous bundles and/or lumps necessarily result in the nonwoven fabric presenting uneven fiber distribution, rough touch and more or less spotted appearance. While such defects of the nonwoven fabric are not remarkable so far as the nonwoven fabric is of component fibers each having a diameter less than 3 $\mu$m, such defects can no more neglected and its functional value as well as its commercial value will correspondingly go down if the fiber diameter is as large as in order of 10~20 $\mu$m.

SUMMARY OF THE INVENTION

It is an object of this invention to provide a process and an apparatus enabling a nonwoven fabric to be made without an anxiety-of forming bundles and/or lumps of continuous component fibers even if each of these component fibers has a relatively large diameter.

According to a first aspect of this invention, there is provided a novel process for making a nonwoven fabric and, according to a second aspect of this invention, there is a novel apparatus used to exploit the novel process.

Specifically, according to the first aspect of this invention, there is a process for making a nonwoven fabric comprising the steps of stretching and thereby thinning continuous fibers of thermoplastic synthetic resin discharged from a melt-extruder under hot air blast and then placing these continuous fibers upon conveyor means.

The process further comprises, there being provided a guide box located between the extruder and the conveyor means, the guide box having an upper end opening spaced apart from nozzles of the extruder by a predetermined distance and adapted to receive the stretched and thinned continuous fibers and a lower end opening formed adjacent the conveyor means and having a width larger than the upper end opening as viewed in a travelling direction of the conveyor means and suction means located under the conveyor means so as to in opposition to the guide box, the steps of putting the stretched and thinned continuous-fibers in order within the guide box so that the stretched and thinned continuous fibers flow in well ordered manner from the upper end opening toward the lower end opening, then secondarily further stretching, thinning, cooling the continuous fibers at a flow velocity of the fibers maintained or increased in vicinity of the upper end opening, and placing the continuous fibers upon the conveyor means.

According to the second aspect of this invention, there is provided an apparatus adapted to stretch and thereby to thin continuous fibers of thermoplastic synthetic resin discharged from a melt-extruder under hot air blast and then to place these continuous fibers upon conveyor means, the apparatus comprising a guide box located between the extruder and the conveyor means, the guide box having an upper end opening spaced apart from nozzles of the extruder by a predetermined distance and adapted to receive the stretched and thinned continuous fibers and a lower end opening formed adjacent the conveyor means and having a width larger than the upper end opening as viewed in a travelling direction of the conveyor means and suction means located below the conveyor means so as to be opposed to the guide box with the conveyor means therebetween, the suction means being capable of putting the continuous fibers in order, the continuous fibers being subjected to the hot air blast and then secondarily further stretching, thinning and cooling the continuous fibers by maintaining or accelerating a flow velocity of the continuous fibers in vicinity of the upper end opening.

The apparatus and the process according to this invention for making the nonwoven fabric enable the continuous fibers discharged from the melt-extruder to be introduced into the guide box in the well ordered condition substantially similar to the condition in which the continuous fibers have been discharged. In addition, the apparatus and the process according to this invention enable the velocity of the continuous fibers immediately after discharged to be maintained or increased so that the continuous fibers may be effectively stretched and thereby thinned while they are gradually cooled. In this way, this invention provides the nonwoven fabric free from any bundle and/or clump of the fibers and offering a comfortable touch.

DETAILED DESCRIPTION OF THE PREFERRED EMBODIMENTS

Details of a process and an apparatus according to this invention for making a nonwoven fabric will be more fully understood from the description given hereunder with reference to the accompanying drawings.

Figure 1:
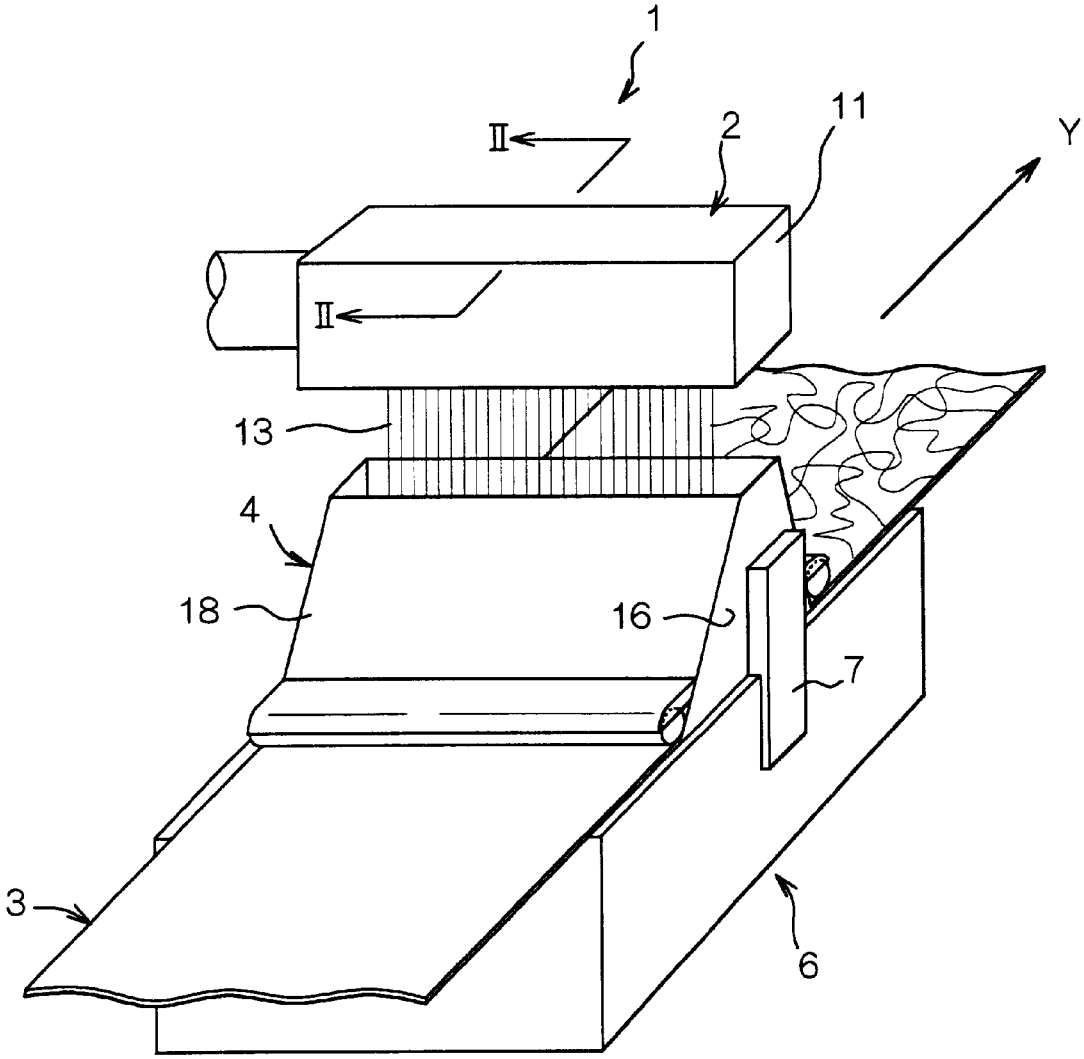
FIG. 1 is a perspective view of the apparatus according to this invention.

FIG. 1 is a fragmentary perspective view of an apparatus 1 according to this invention for making a nonwoven fabric. The apparatus 1 comprises a melt-extruder 2, an endless belt 3 running below the extruder 2, a guide box 4 located between the extruder 2 and the endless belt 3 and a suction box 6 located to be opposed to the opposed to the guide box 4 with the endless belt 3 therebetween. The endless belt 3 runs in a direction indicated by an arrow Y and made of breathable material in order to ensure the suction box 6 may properly act upon the guide box 4 as the endless belt 3 travels immediately above the suction box 6. The guide box 4 is supported by a pair lateral supports 7 in vertical movable manner.

Figure 2:
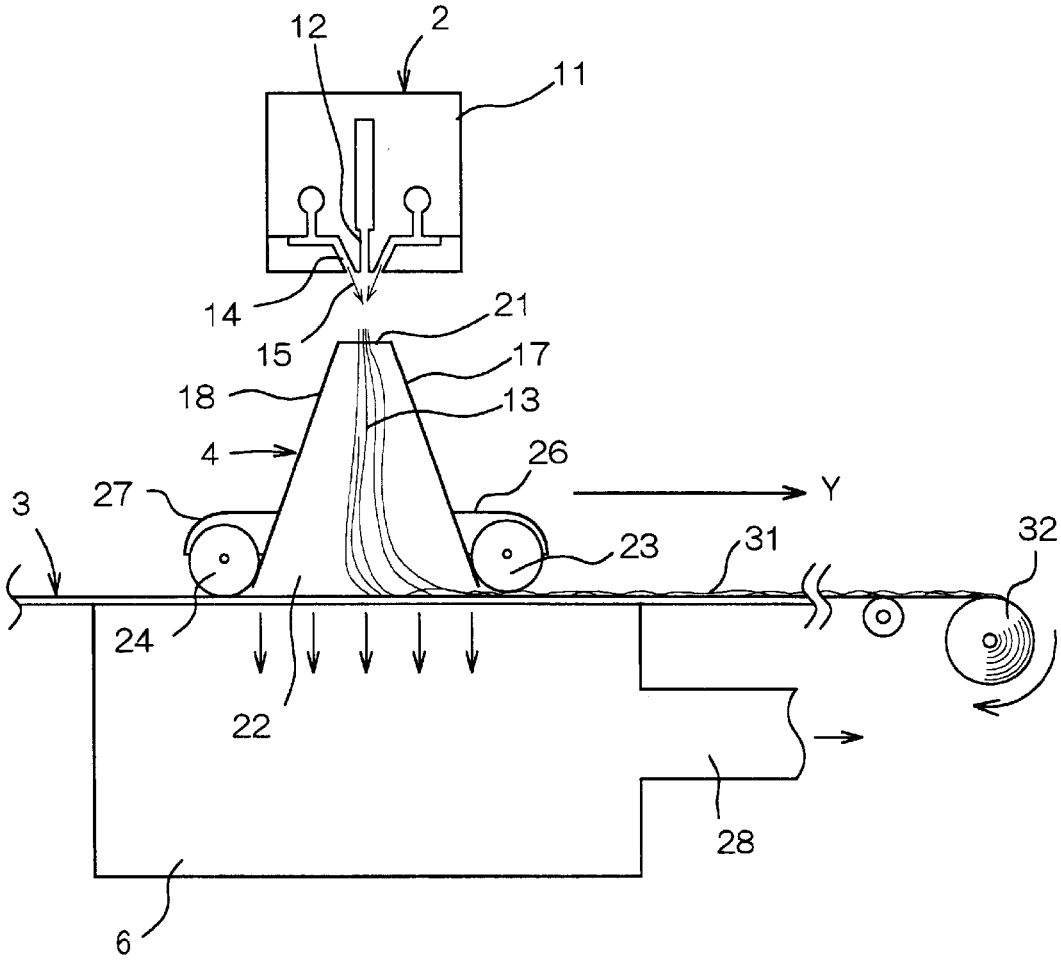
FIG. 2 is a sectional view taken along line II—II in FIG. 1.

FIG. 2 is a sectional view taken along line II—II in FIG. 1. The extruder 2 is provided within its head 11 with a plurality of extruding nozzles 12 adapted to discharge thermoplastic synthetic resin fibers 13 in molten state which are then stretched and thereby thinned under hot air blast 15 injected from hot air nozzles 14.

The guide box 4 underlying the head 11 has a pair of side walls 16 lying in the vicinity of transversely opposite sides of the belt 3 as viewed in FIG. 1, a front wall 17 and a rear wall 18 as viewed in the running direction of the belt 3. The guide box 4 presents a trapezoidal cross-section and has an upper end opening 21 immediately underlying the extruding nozzles 4 and a lower end opening 22 formed adjacent the upper surface of the belt 3. The lower end opening 22 has a width larger than that of the upper end opening 21 as viewed in the running direction of the belt 3. In the vicinity of the lower end opening 22, the front and rear walls 17, 18 are respectively provided on outer surfaces thereof with front and rear rollers 23, 24. These rollers 23, 24 rotate in the travelling direction Y of the belt 3 as the belt 3 runs. These rollers 23, 24 are vertically movable slightly but sufficiently to substantially close a gap defined between the lower ends of the front and rear walls 17, 18 and the belt 3. In other words, the front roller 23 is mounted on the front wall 17 so that a gap defined between the lower end of the front wall 17 and fibrous web 31 being conveyed on the belt 3 may be substantially closed by the front roller 23 and the rear roller 24 also is similarly mounted on the rear wall 18. The rollers 23, 24 have their upper halves protected by covers 26, 27 extending outward from the front and rear walls 17, 18, respectively.

The suction box 6 is connected to a vacuum pump (not shown) via a pipe 28. A suction effect of the suction box 6 exerted on the guide box 4 enables the outside air to be forcibly introduced into the guide box 4 through the relatively small upper end opening 21 toward the lower end opening 22. The outside air into the guide box 4 in this manner serves not only to keep the fibers 13 discharged from a plurality of the extruding nozzles 12 arranged transversely of the belt 3 in well ordered condition but also to maintain or increase, in the vicinity of the upper end opening 21, a velocity of the fibers 13 after discharged. In this way, the fibers 13 can be further stretched and thereby thinned in the upper end opening 21. In addition, the fibers 13 are cooled in perfectly or substantially well ordered condition and collected on the belt 3. Consequently, it is not apprehended that the fibers 13 might be broken before collected on the belt 3 or fused together to form fibrous bundles and/or intertwined together to form fibrous lumps.

The fibers accumulated on the belt 3 are converted to web 31 which is conveyed in the direction Y through a small gap between the front wall 17 of the guide box 4 and the belt 3 and then taken up in the form of nonwoven fabric 32. Outside the front wall 17, the roller 23 is rotating in the direction Y as the roller 23 is kept in contact with the upper surface of the web 31. The presence of the front roller 23 reliably prevents the outside air from entering into the gap defined between the front wall 17 and the belt 3.

Figure 3:
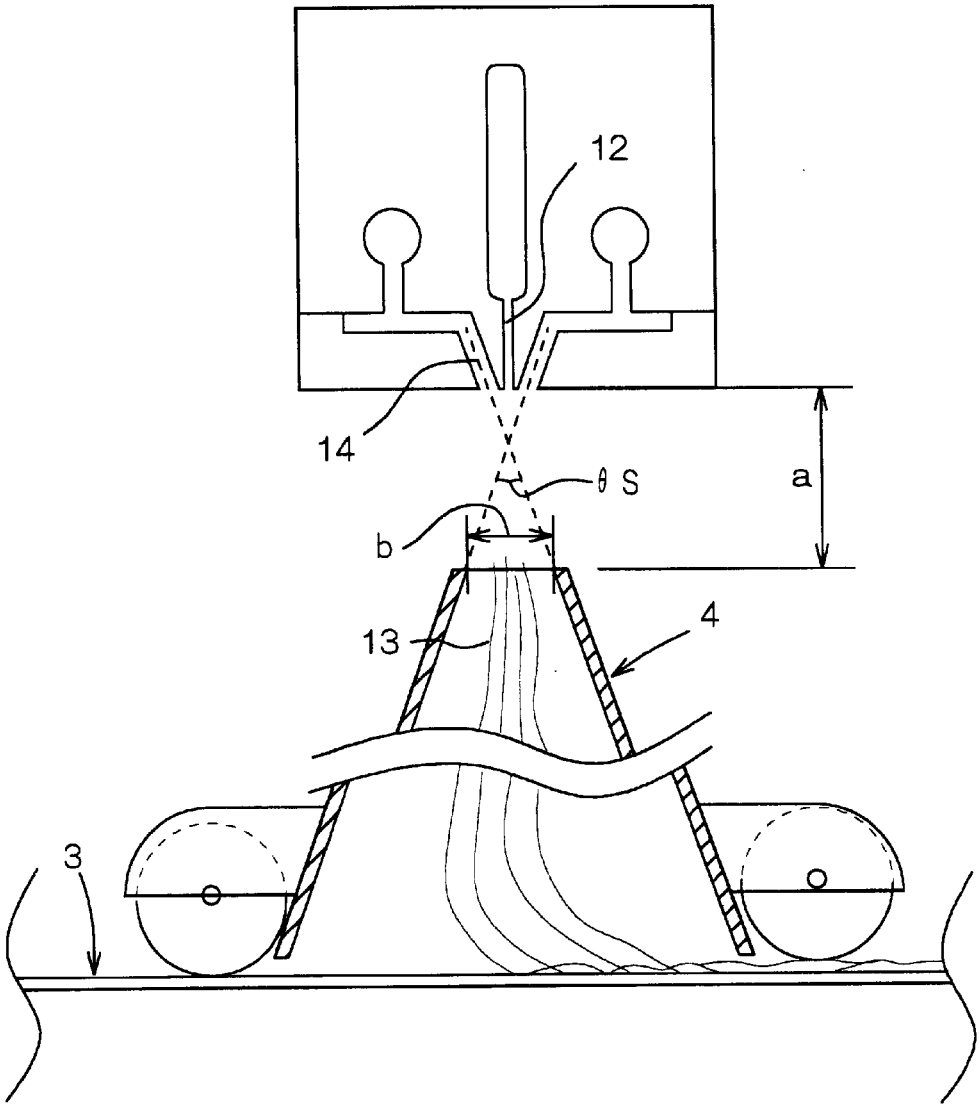
FIG. 3 is a diagram illustrating the important part of FIG. 2 in an enlarged-scale.

FIG. 3 is a diagram illustrating the important part of FIG. 2 in an enlarged-scale. The illustrated embodiment uses the extruding nozzles 12 each having a diameter=0.45 mm and arranged at a pitch=1 mm.

The illustrating embodiment uses the guide box 4 of which the upper end opening 21 has a width b=10~100 mm, the front and rear walls 17, 18 define an angle of intersection θs=30~60°. The guide box 4 is spaced apart from the extruding nozzles 12 by a dimension a=10~200 mm and lies at a level=50~400 mm as measured from the belt 3.

For the apparatus 1 shown in FIGS. 1~3, styrene-based elastomer of tri-block type having MFR=70 g/10 min (2.16 kg at 230° C.) was used as raw material for the continuous fibers 13 which was discharged at a rate=0.13 g/min/hole at a resin temperature=270° C. under hot air blast injected at a rate=2.5 $Nm^3$/min. Operation of the apparatus 1 at a suction air blast rate=42 $m^3$/min and a belt speed=3.3 m/min resulted in a fiber velocity=662 m/min immediately after discharged and a fiber velocity=1062 m/min in the vicinity of the upper end opening 21. Thus the nonwoven fabric 32 was obtained in which the component fibers 13 are evenly distributed and neither the bundles nor the lumps of these component fibers 13 are present. Operation of the apparatus 1 with the guide box 4 eliminated therefrom resulted in the nonwoven fabric which was observed to comprise continuous fibers each having an average diameter of 17 μm and to have a plurality of fibrous bundles and/or lumps.

What is claimed is:

1. A process of making a nonwoven fabric, said process comprising the steps of:

discharging continuous fibers of a thermoplastic synthetic resin from a melt-extruder;

stretching, and thereby thinning, the discharged continuous fibers by a hot air blast; and placing the stretched continuous fibers upon a conveyor located below the melt-extruder to form the non-woven fabric;

said placing comprising the steps of:

providing a guide box between said melt-extruder and said conveyor, said guide box having an upper end opening spaced from nozzles of said melt-extruder by a predetermined distance and adapted to receive said stretched continuous fibers and a lower end opening adjacent said conveyor and having a dimension larger than said upper end opening as measured in a traveling direction of said conveyor; and generating a suction under said conveyor to cause said stretched continuous fibers to flow within said guide box in a well ordered manner from said upper end opening to said lower end opening;

wherein said suction is sufficient to cause further stretching, thinning, and cooling of said continuous fibers and to cause a flow velocity of said fibers in a vicinity of said upper end opening to be equal to or greater than a flow velocity of said fibers after being discharged form the melt-extruder.

2. A process of making a nonwoven fabric, said process comprising the steps of:

discharging continuous fibers of a thermoplastic synthetic resin from a melt-extruder;

stretching, and thereby thinning, the continuous fibers by blowing air from an air nozzle onto said continuous fibers being discharged; and placing the stretched continuous fibers upon a conveyor located below the melt-extruder to form the non-woven fabric;

said placing comprising the steps of:

providing a guide box between said melt-extruder and said conveyor, said guide box having an upper end opening spaced from nozzles of said melt-extruder by a predetermined distance and receiving said stretched continuous fibers, and a lower end opening adjacent said conveyor and having a dimension larger than said upper end opening as measured in a traveling direction of said conveyor; and generating a suction under said conveyor to cause said stretched continuous fibers to flow within said guide box from said upper end opening to said lower end opening; wherein said suction is sufficient to cause further stretching, and hence thinning, of said continuous fibers in said guide box and to cause a flow velocity of said fibers in a vicinity of said upper end opening to be equal to or greater than a flow velocity of said fibers after being discharged form the melt-extruder; and said upper end opening of said box is spaced from said nozzles by a distance of 10~200 mm.

3. A process of making a nonwoven fabric, said process comprising the steps of:

discharging continuous fibers of a thermoplastic synthetic resin from a melt-extruder;

stretching, and thereby thinning, the continuous fibers by blowing air from an air nozzle onto said continuous fibers being discharged; and placing the stretched continuous fibers upon a conveyor located below the melt-extruder to form the non-woven fabric;

said placing comprising the steps of:

providing a guide box between said melt-extruder and said conveyor, said guide box having an upper end opening spaced from nozzles of said melt-extruder by a predetermined distance and receiving said stretched continuous fibers, and a lower end opening adjacent said conveyor and having a dimension larger than said upper end opening as measured in a traveling direction of said conveyor; and generating a suction under said conveyor to cause said stretched continuous fibers to flow within said guide box from said upper end opening to said lower end opening; wherein said suction is sufficient to cause further stretching, and hence thinning, of said continuous fibers in said guide box and to cause a flow velocity of said fibers in a vicinity of said upper end opening to be equal to or greater than a flow velocity of said fibers after being discharged form the melt-extruder; and said guide box has a pair of walls opposed to each other in the traveling direction of said conveyor and sloping with respect to said traveling direction so as to converge upwardly from said lower end opening toward said upper end opening at which said walls are spaced from each other by a distance of 10~100 mm as measured in the traveling direction.

4. The process according to claim 3, wherein said walls are slanted at an angle of 30~60° relative to each other.

5. The process according to claim 3, wherein said walls are in substantially close contact with said conveyor at a level of said lower end opening.

6. The process according to claim 5, further comprising providing a pair of rollers each mounted on one of said walls, in a vicinity of said lower end opening so that the rollers rotate in said traveling direction of said conveyor.

7. An apparatus for making non-woven fabric by stretching, and thereby thinning, continuous fibers of a thermoplastic synthetic resin discharged from a melt-extruder by a hot air blast and then placing the stretched continuous fibers upon a conveyor located below said melt-extruder, said apparatus comprising:

a guide box located between said melt-extruder and said conveyor, said guide box having an upper end opening spaced from nozzles of said melt-extruder by a predetermined distance and adapted to receive said stretched continuous fibers, and a lower end opening adjacent said conveyor and having a dimension larger than said upper end opening as measured in a traveling direction of said conveyor;

a suction source located below said conveyor, said suction source being sufficiently strong to put the continuous fibers in order, cause further stretching, thinning and cooling of said continuous fibers, and maintain or accelerate a flow velocity of said continuous fibers in a vicinity of said upper end opening; and hot air nozzles surrounding and adjacent to the nozzles of said melt-extruder for blowing the hot air blast on the continuous fibers being discharged from the nozzles of said melt-extruder.

8. The apparatus according to claim 7, wherein said guide box has a pair of walls opposed to each other in the traveling direction of said conveyor and said walls are respectively provided in the vicinity of said lower end opening with rollers adapted to rotate in said traveling direction of said conveyor so that said rollers substantially close a gap between the lower end opening of said guide box and an upper surface of said conveyor.

9. The apparatus according to claim 7, further comprising said melt-extruder and said conveyor.

10. The apparatus according to claim 9, further comprising a hot air source coupled to said hot air nozzles.

11. An apparatus for making non-woven fabric, said apparatus comprising:

a melt-extruder for discharging continuous fibers of a thermoplastic synthetic resin;

a conveyor positioned below said melt-extruder for receiving the continuous fibers;

a guide box located between said melt-extruder and said conveyor, said guide box having an upper end opening spaced from nozzles of said melt-extruder by a distance of 10~200 mm and adapted to receive said continuous fibers, and a lower end opening adjacent said conveyor and having a dimension larger than said upper end opening as measured in a traveling direction of said conveyor; and a suction source located below said conveyor.

12. The apparatus according to claim 11, further comprising hot air nozzles surrounding and adjacent to the nozzles of said melt-extruder for blowing hot air on the continuous fibers being discharged from the nozzles of said melt-extruder, thereby stretching the continuous fibers.

13. An apparatus for making non-woven fabric, said apparatus comprising:

a melt-extruder for discharging continuous fibers of a thermoplastic synthetic resin;

a conveyor positioned below said melt-extruder for receiving the continuous fibers;

a guide box located between said melt-extruder and said conveyor, said guide box having an upper end opening spaced from nozzles of said melt-extruder by a predetermined distance and adapted to receive said continuous fibers, and a lower end opening adjacent said conveyor and having a dimension larger than said upper end opening as measured in a traveling direction of said conveyor; and a suction source located below said conveyor;

wherein said guide box has a pair of walls opposed to each other in the traveling direction of said conveyor and sloping with respect to said traveling direction so as to converge upwardly from said lower end opening toward said upper end opening at which said walls are spaced from each other by a distance of 10~100 mm as measured in the traveling direction.

14. The apparatus according to claim 13, wherein said walls are slanted at an angle of 30~60° relative to each other.

15. The apparatus according to claim 13, further comprising a pair of rollers each mounted on one of said walls in a vicinity of said lower end opening so that the rollers substantially close a gap between the lower end opening of said guide box and an upper surface of said conveyor.

16. The apparatus according to claim 13, further comprising hot air nozzles surrounding and adjacent to the nozzles of said melt-extruder for blowing hot air on the continuous fibers being discharged from the nozzles of said melt-extruder, thereby stretching the continuous fibers.

17. The method according to claim 1, further comprising the step of accelerating, by said suction, the flow velocity of said fibers in the vicinity of said upper end opening to be greater than the flow velocity of said fibers immediately after being discharged form the nozzles of the melt-extruder.

18. The method according to claim 1, further comprising the step of allowing the fibers to cross an air gap between the upper end opening of said guide box and the nozzles of said melt-extruder immediately after being discharged from the nozzles of said melt-extruder.

19. The method according to claim 18, wherein the suction is sufficiently strong so as to cause air drawn from the air gap into said upper end opening to accelerate the flow velocity of said fibers in the vicinity of said upper end opening to be greater than the flow velocity of said fibers immediately after being discharged form the nozzles of the melt-extruder.

* * * * *